US005161735A

United States Patent [19]

Bendel

[11] Patent Number: 5,161,735

[45] **Date of Patent: * Nov. 10, 1992**

[54] SELF-CONTAINED INSERT MAILER

[76] Inventor: Bruce Bendel, 1545 White Oak Rd., Lake Forest, Ill. 60045

[ * ] Notice: The portion of the term of this patent subsequent to Oct. 2, 2007 has been disclaimed.

[21] Appl. No.: 742,043

[22] Filed: Aug. 8, 1991

Related U.S. Application Data

[63] Continuation-in-part of Ser. No. 528,685, May 24, 1990, abandoned, which is a continuation of Ser. No. 229,989, Aug. 9, 1988, Pat. No. 4,960,237.

[51] Int. Cl.[5] ..... B65D 27/06; B65D 27/10; B65D 27/34

[52] U.S. Cl. ..... 229/303; 229/69; 229/92.3; 229/92.8; 229/300

[58] Field of Search ..... 229/69, 71, 92.1, 92.3, 229/92.8, 300, 301, 303, 80.5

[56] References Cited

U.S. PATENT DOCUMENTS

| | | | |
|---|---|---|---|
| 225,319 | 3/1880 | Barton | 229/92.1 |
| 2,279,164 | 4/1942 | Gettleman | 229/300 X |
| 3,061,173 | 10/1962 | Sawdon | 229/300 |
| 3,197,121 | 7/1965 | Hayes, Jr. | 229/92.1 |
| 3,228,586 | 1/1966 | Hayes, Jr. | 229/92.1 X |
| 3,652,007 | 3/1972 | MacDougall | 229/80.5 X |
| 3,726,471 | 4/1973 | Kalb | 229/300 X |
| 4,102,489 | 7/1978 | Lucas | 229/92.3 X |
| 4,625,909 | 12/1986 | Ferrando | 229/69 X |
| 4,778,101 | 10/1988 | Paquin | 229/71 X |
| 4,960,237 | 10/1990 | Bendel | 229/69 X |

FOREIGN PATENT DOCUMENTS

| | | | |
|---|---|---|---|
| 2225000 | 10/1974 | France | 229/73 |

*Primary Examiner*—Stephen Marcus
*Assistant Examiner*—Jes F. Pascua
*Attorney, Agent, or Firm*—Lockwood, Alex, FitzGibbon & Cummings

[57] ABSTRACT

A self-contained insert mailer includes at least two similarly sized and interconnected individual plies which are arranged in overlying relationship to form an outgoing mailer containing an outgoing envelope, one or more insert plies and, in some instances, a reply means. The mailer is folded along one or more outgoing envelope fold lines so that the front ply adhesively engages the back ply to define an outgoing envelope containing the insert plies therebetween. Where the mailer is folded along the outgoing envelope fold lines, the outgoing envelope has a height to length ratio which is between 1:1.3 and 1:2.5.

20 Claims, 3 Drawing Sheets

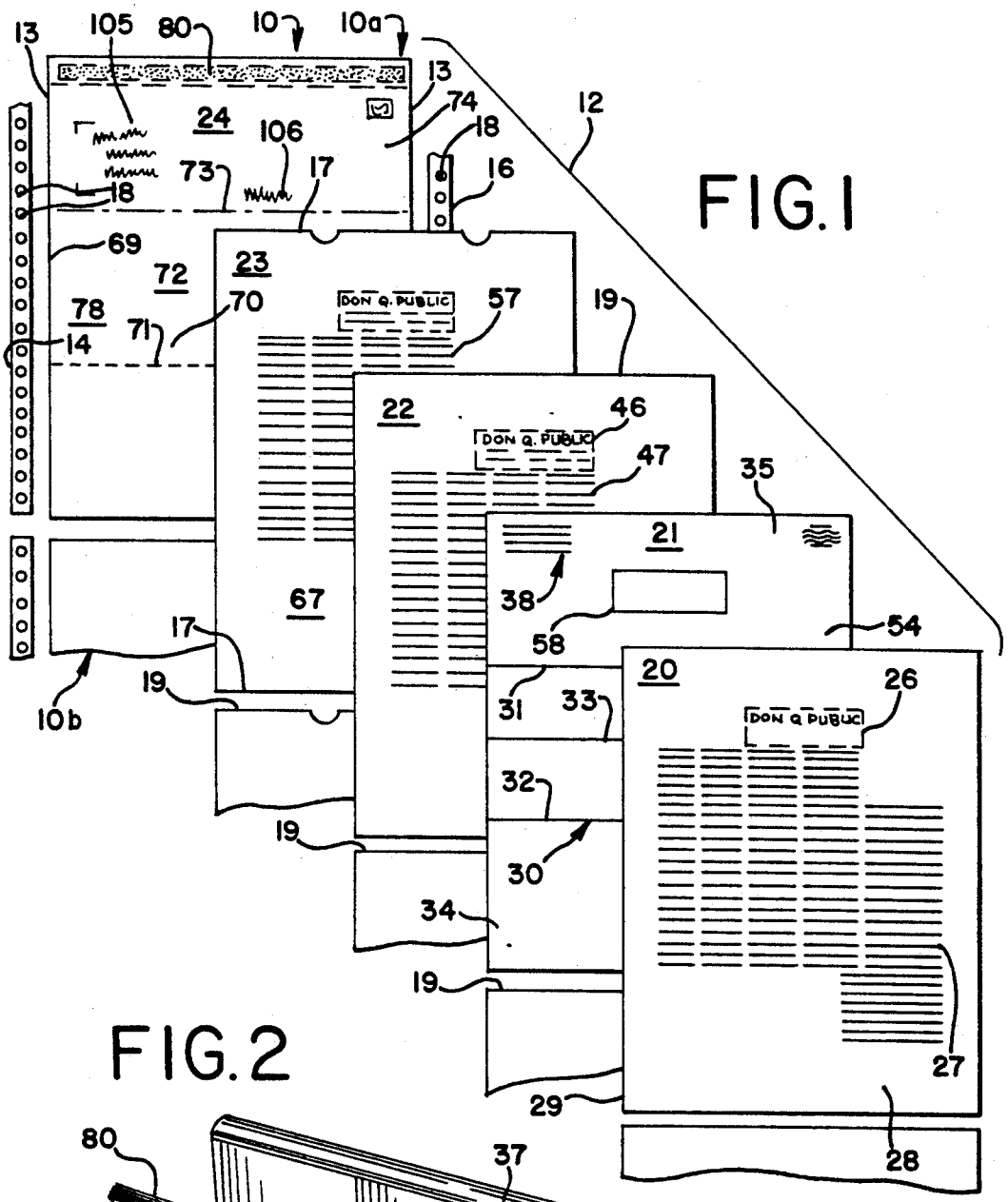
FIG. 1
FIG. 2
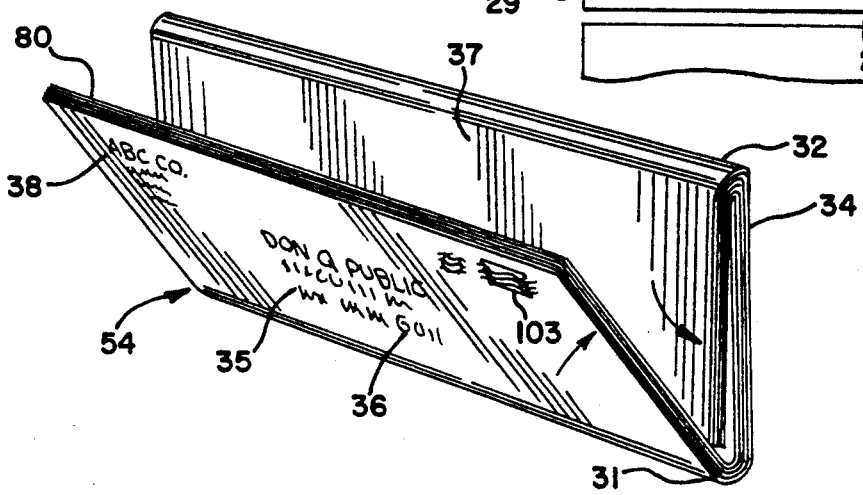

LETTER-SIZE MAIL DIMENSIONAL STANDARDS

SELF-CONTAINED INSERT MAILER

RELATED APPLICATIONS

This application is a continuation-in-part application of Ser. No. 528,685, filed May 24, 1990, now abandoned, which is a continuation of application Ser. No. 229,989, now U.S. Pat. No. 4,960,237.

BACKGROUND AND SUMMARY OF THE PRESENT INVENTION

The present invention relates generally to an improved a self-contained insert mailer and more particularly, to a mailer assembly having insert message sheets and a separate, detachable reply portion incorporated therein.

Various types of mailers are widely used by billing authorities for mailing billing information to customers. To speed the billing process, multi-part billing mailers have been developed which typically contain a billing statement or statements and a preaddressed return envelope inserted within the outgoing mailer envelope.

The U.S. Postal Service issued new postal regulations in 1978, which defined the dimensions of "standard size" first class letter-size mail. These regulations further imposed an additional postage surcharge on "non-standard" sizes, i.e. those pieces which exceeded the regulations' dimensional guidelines. For first class weighing 1 ounce or less, a mail piece was considered "standard" if (1) it had a minimum dimension of 3½ inches high by 5 inches long, or (2) it had a maximum dimension of 6½ inches high by 11 inches long, or (3) it exceeded the minimum dimensions and fell under the maximum dimensions, but had a height to length ratio of greater than or equal to 1 to 1.3 and less than or equal to 1 to 2.5. Any envelopes which satisfied this criteria required only normal first class postage; other sizes required additional postage for first class mailing. In order to avoid this postal surcharge, the maximum size envelope and accompanying insert plies which can be used in insert mailers are limited to less than or equal to 6½ inches high by 11 inches long. As such, the amount of billing or message information in such mailers is restricted to that which can fit on such sized inserts. In order to accommodate customers with large amounts of billing or message information which extend more than 6 inches deep on an insert, mailing authorities are faced with three mailer choices.

First, the mailing authority can use a smaller size typeface on an automated printer and increase the number of lines per inch of billing or message information on its insert. This typically requires that the printer be reprogrammed to accommodate the new typeface and spacing, which is costly and may not ensure that all the information will fit on one insert. Secondly, the mailing authority can mail out a large envelope with large billing insert plies and pay the additional postage, which increases the cost of billing. Thirdly, the mailing authority can send multiple outgoing bills or messages to the customer, which avoids the postal surcharge but effectively multiplies the cost of mailing and/or billing. Therefore, a need exists for an insert mailer having at least one insert ply which is larger than 6 inches high and which ply can accommodate large amounts of billing or message information, and which falls within the Postal Service standard size guidelines.

In addition, the use of optical character readers for processing mail by the U.S. Postal Service is growing.

These readers scan the face of mail envelopes to read bar codes (which typically indicate that the mail piece is business reply mail) as well as addresses. The Postal Service has issued specifications for the location of these bar codes and addresses so that the bar codes and addresses of mail pieces fall within the scanning area of the optical character readers.

A typical mailer construction is disclosed in U.S. Pat. No. 4,418,865, wherein a multi-ply continuous mailer is assembled by aligning a plurality of plies and adhesively securing the front and back plies together to define an outgoing envelope which contains one or more insert message or billing plies. The outgoing envelope, after being opened, is then assembled by the customer to form a return envelope for returning the bill payment. The customer opens the outgoing envelope by removing a tear strip disposed along the top ply to free the insert message plies from the outgoing envelope. The portion of the back ply which remains is folded over the front face of the outgoing envelope to form a return envelope and to conceal the original address.

This mailer construction suffers from several shortcomings. First of all, the insert plies must be sized to lie within the borders of the outgoing envelope. Therefore, the maximum size of the inserts is limited not only by the size of the outgoing envelope, which is typically 6 inches high by 11 to 11½ inches long, but also by the width of the marginal edge glue strips which hold the outgoing envelope together. These envelope glue strips encroach upon the width of the billing insert and reduce the available billing information area thereon. Moreover, the tear strip which frees the insert message plies and return envelope from the outgoing envelope also encroaches upon the size of the insert. These restrictions on the size of the insert plies, result in an average loss of 1 to 2 inches of vertical billing space on the insert message plies.

Secondly, in this type mailer the billing inserts are contained within a preformed return envelope and therefore must be inserted or stuffed into the outgoing envelope formed by the front and back plies. This insertion step is labor-intensive and is costly.

The self-contained insert mailer of the present invention overcomes the aforementioned shortcomings. A self-contained insert mailer incorporating the principles of the present invention, can accommodate a plurality of billing insert, outgoing and return portion plies as large as 12 to 18 inches high by 11 to 11½ inches long. When folded along appropriate outgoing envelope fold lines, the final dimensions of the insert mailer of the present invention fall within the Postal Service height to length ratio of greater than or equal to 1 to 1.3 and less than or equal to 1 to 2.5, thereby accommodating larger amounts of billing information and avoiding the first-class surcharge for non-standard sizes. In addition, the addresses and zip codes on the mailer outgoing envelope and mailer return envelope are easily positioned within the prescribed area for optical character reading by Postal Service processing equipment and thus, no reprogramming of the billing print format is necessary.

In one principal aspect of the present invention, a self-contained insert mailer includes a plurality of individual, adjacently overlying plies which are interconnected together to form an insert mailer assembly. The front ply of the mailer assembly defines an outgoing billing envelope. The mailer assembly includes one or more insert plies disposed adjacently beneath the back ply defines a return portion. The insert mailer is folded upon itself along appropriately placed first and/or second fold lines and the front ply adhesively engages the back ply to form an outgoing envelope which has a height to length ratio which falls between 1 and 1.3 and 1 to 2.5.

In another principal aspect of the present invention, the insert mailer assembly includes a second back ply disposed adjacently beneath the back ply and is adhesively secured to the back ply to define a return envelope having an envelope pocket therebetween. Similar to the outgoing envelope, the return envelope also has a height to length ratio which falls between 1 to 1.3 and 1 to 2.5.

In still another principal aspect of the present invention, the insert mailer assembly back ply includes adhesive means peripherally disposed thereon and a return portion fold line separating the back ply into a return portion and a message portion, such that the back ply return portion may be easily removed and mailed back by the addressee and is not damaged when the back ply is folded upon itself along the return envelope fold lines thereof.

In yet another principal aspect of the present invention, the front ply and the one or more insert plies of the mailer assembly include an image transfer coating on the rear faces thereof so that the billing information can be printed onto a mailer by an impact printer after assembly rather than prior to assembly. The billing information is transferred to the underlying plies. This allows the billing authority to print its own mailers, and eliminates the need for billing printing to be done offsite at the mailer assembly plant.

These and other objects, features and advantages of the present invention will be clearly understood through a consideration of the following detailed description.

BRIEF DESCRIPTION OF THE DRAWINGS

In the course of this description, reference will be made to the attached drawings, in which:

FIG. 1 is an exploded view of one embodiment of a self-contained insert mailer constructed in accordance with the principles of the present invention;

FIG. 2 is a view of the insert mailer of FIG. 1 showing how the mailer is folded along first and second outgoing envelope fold lines to form the mailer outgoing envelope;

DETAILED DESCRIPTION OF THE PREFERRED EMBODIMENTS

Figure 3:
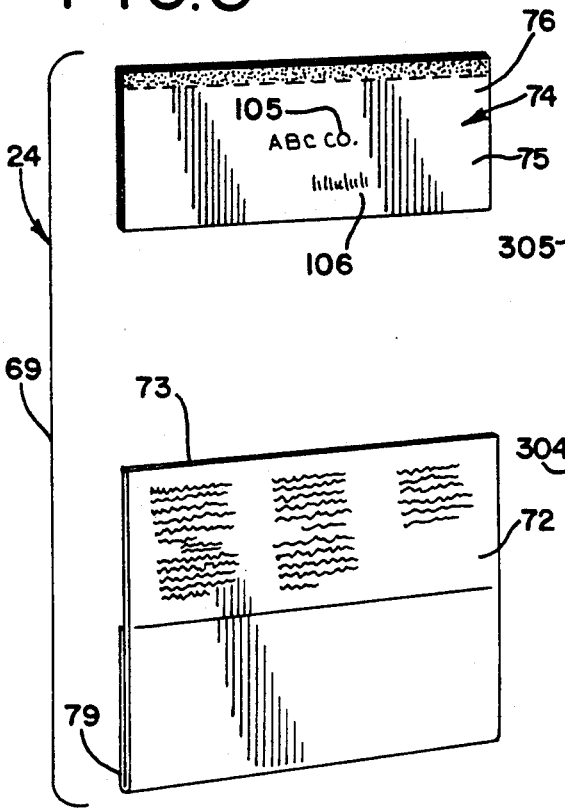
FIG. 3 is a view of the rear ply of the mailer of FIG. 1 showing the return portion being detached from the back ply.

Referring to FIG. 1, one embodiment of a self-contained insert mailer 10 constructed in accordance with the principles of the present invention is shown as having a plurality of individual sheets or plies 12. The plies 12 are disposed in adjacent overlying relationship, and may be interconnected by conventional sealing means, such as heat-activated adhesive deposited along one or more of the plies transverse edges 17 or along the marginal edges 13 of the plies 12 to form a single mailer 10. Each ply 12 may utilize removable feed strips 14, 16 disposed along opposite marginal edges 13 of individual mailer units provided with control holes 18 in order to engage pins on various printer and assembler feed rolls (not shown) used in assembling and bursting the mailers. As shown, the transverse edges 17 of the plies are typically provided with lines of weakening 19, such as spaced perforations, which extend transversely between the removable feed strips 14, 16 to aid in separating or bursting a single mailer 10*a* from an adjacent mailer 10*b*.

The individual mailer 10 may include an outgoing envelope 54, a series of billing inserts 22, 23 and a back ply 70. This mailer embodiment includes five individual plies 20, 21, 22, 23 and 24 of generally equal size. The lines of weakening 19 extend transversely between the feed strips 14, 16 and divide a continuous sheet of plies into a series of detachably interconnected individual multiple ply mailers 10. A removable first ply 20 or flysheet may be disposed on top of the individual mailer adjacently overlying the plurality of plies 21–24 and in detachable engagement therewith. This flysheet 20 may be used to contain preprinted customer address information 26 and billing or message information 27 on its front face 28 to serve as a record for the mailing authority. The flysheet 20 is typically detached or decollated from individual mailers after exiting from an impact printer. The flysheet 20 may contain conventional image transfer means on its rear face 29 in the designated billing, message and address information areas 26, 27, such as either a spot carbon coating or a carbonless transfer medium, to transfer the printed address and billing information onto one or more of the underlying mailer plies.

The second, or front ply 21, is disposed adjacently beneath the flysheet 20 shown and overlying the remaining plies 22–24, and is generally aligned therewith along its marginal and transverse edges. Front ply 21 serves as an outgoing envelope ply which defines the outgoing envelope 54 of the mailer 10 which contains billing or message inserts 22, 23 and a return envelope 70. The front ply 21 may also contain an image transfer means such as that described above on its rear face so that the billing information 27 printed on the flysheet 20 will transfer through to the first and second insert plies 22 and 23. Alternatively, the message information on the inserts, 23,24 may be preprinted.

The front ply 21 includes an outgoing envelope face portion 35 which may contains conventional customer address information 36 and a return address 38, an outgoing envelope back portion 34 and an outgoing envelope intermediate portion 37 that is located between the face and back portions 35, 34 when the mailer is folded. These three outgoing envelope portions are separated by outgoing envelope fold lines 30, shown as first fold line 31 and second fold line 32 in FIG. 1, which are generally spaced apart so as to generally divide the outgoing envelope ply 21 into three portions of substantially equal height.

The customer address 36 may be either printed directly on the outgoing envelope ply face portion 35 (FIG. 2), or it may be printed directly on the flysheet 20 and transferred to the ply 21 as described above, or it may yet be printed on the first message insert ply 22. In the latter case, the front ply 21 will have a conventional address window 58 die cut therein to allow the first insert customer address 46 or any portion of a message thereon to show through. (FIG. 1) In this embodiment, the outgoing envelope 54 is initially formed when the mailer 10 is folded along the first and second fold lines 31 and 32, and is completed by adhering the back ply 24 to the outgoing envelope intermediate portion of front ply 20 by way of a suitable adhesive strip 80. (FIG. 2) When assembled, the customer address 36 is positioned in the area of the outgoing envelope specified by the Postal Service for automated, optical character reading processing.

Figure 4:
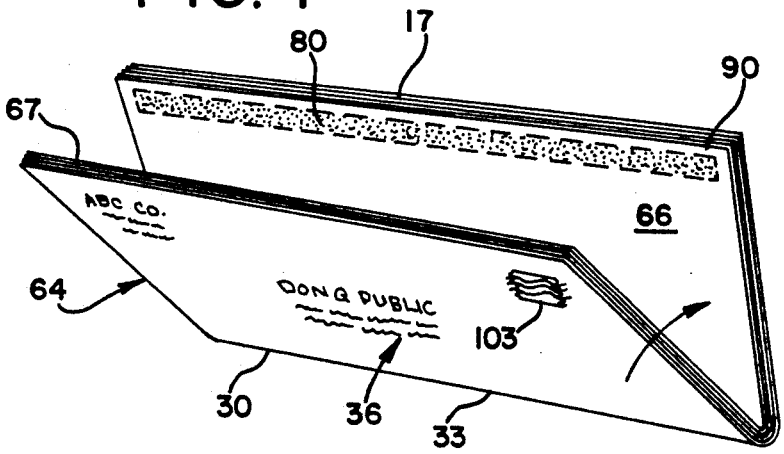
FIG. 4 is a view of the insert mailer of FIG. 1 showing how the mailer is folded along a first outgoing envelope fold line to form the mailer outgoing envelope.

Alternately, as shown in FIG. 4, the mailer 10 can be folded upon itself once along a single fold line 33, which is spaced between the top and bottom transverse edges 17, so as to generally divide the front ply 21 and the ensuing outgoing envelope 64 into two equal portions of substantially the same height. Similar to the first embodiment, when the mailer shown in FIG. 4 is folded into an outgoing envelope, the customer address is positioned in the area specified by the Postal Service for optical character reading thereof. In this one-fold configuration, the outgoing envelope 64 is completed in a similar manner as the outgoing envelope 54 shown in FIG. 2, that is, by adhering the adhesive strip 80 on the rear of the back ply 66 to the opposing face 67 of the mailer back ply 25.

The third and fourth plies 22, 23 are message insert plies which contain the customer billing or message information, or 47, 57 and are disposed adjacently beneath the front ply 21 in generally alignment therewith. As described above, since the outgoing envelopes 54, 64 ar assembled by adhering outgoing envelope portions together rather than relying on a glue strip at both transverse edges, virtually the entire height of the insert plies 22 and 23 is available for billing information. The insert plies 22, 23, may include an image transfer means on their rear faces to accommodate the printing of the billing or message information by way of an impact printer to transfers the same from the image transfer means to the various insert message plies. Therefore, the insert mailer of the present invention can be printed by the mailing authority after the mailer has been assembled but not yet folded. Thus, the mailing authority may print the mailers itself, rather than sending mailers off-site to be printed at the assembly plant, prior to assembly of individual mailers.

The remaining ply 24 is disposed adjacently beneath the insert plies 22, 23 and in general alignment with the overlying plies. Importantly, the remaining ply 24 serves as a mailer back ply and may define a return portion or reply ply 69 wherein it may include a lower portion 72 and an upper, detachable return portion 74 such as a postcard 75 separated by transverse lines of weakening 73 as seen in FIG. 1. In this construction, the return portion 74 provides the customer with a return means upon which the customer can answer questions or request for information or goods from the mailing authority. Such a construction is particularly useful in the automotive field where recall notices sent by a car manufacturer request the customer to return information to the manufacturer. Because the return portion 74 is in the form of a postcard 75, no special manipulation of the return ply 69 is necessary by the customer. Additionally, because no glue is required to assemble the reply portion 74, the mailer affords cost and manufacturing advantages over mailers which utilize a return envelope which must be assembled by the customer. Preferably, the transverse lines of weakening 73 of the return ply 69 are spaced apart such that the detachable return portion 74 has dimensions which fall within the Postal Service restrictions discussed in detail below.

The return portion 74, or postcard 75 includes a face portion 76 having a business reply address 105 and a business reply indicator bar code 106 preprinted thereon, and a back portion 78. The business reply address 105 and bar code indicator 106 are positioned within the return envelope face portion 76 so as to be easily read by Postal Service optical character reader processing equipment. The return portion 74 may be individually formed to have a suitable, preselected specific thickness and/or weight, such as by building the return portion 74 up separately from the remainder of the back ply 69. Alternatively, the entire back ply 69 may be formed from a paper stock sufficient to provide the needed rigidity for the postcard 75 to withstand the rigors of mail handling.

Figure 5:
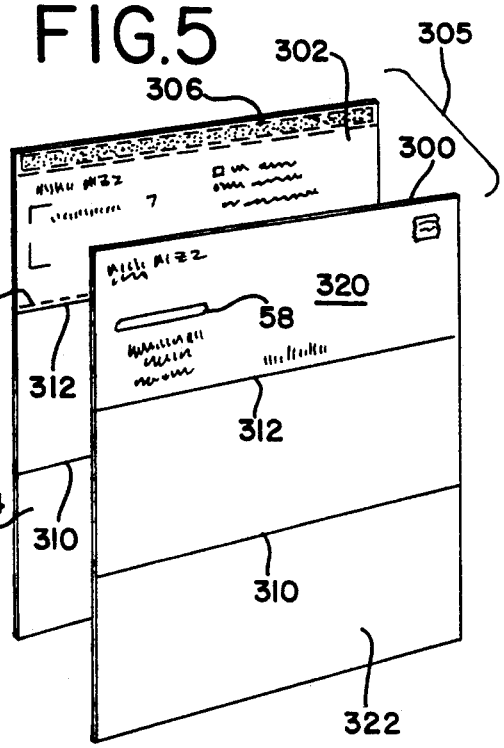
FIG. 5 is a view of a second embodiment of the present invention, utilizing only two plies.

A second embodiment of a mailer constructed in accordance with the principles of the present invention is shown in FIG. 5 as having only a front ply 300 and a back ply 302. No separate insert plies are present in this embodiment. The back ply 302 is disposed adjacently beneath the front ply 300 as previously described and in general alignment therewith. The back ply 302 includes a lower message portion 304 and an upper detachable, return portion 306 which are separated from each other by a transverse line of weakening 305, such as perforations, to allow the customer to easily separate the return portion from the back ply 302. The billing or message information 301 may be printed on both sides of the back ply 302 and the outgoing envelope is easily assembled by folding the overlying plies along one or two transverse fold lines 310, 312, and adhering the outgoing envelope face portion 320 to the flap portion 322 thereof.

Mailers of the present invention need not include the return portion as described above. Rather, in instances when the mailing authority chooses not to send a reply means such as a postcard 75, the mailers may only include the front ply 21 and the one or two insert plies 22 and 23. In such instances, all of the features of the front and insert plies described above are still utilized, such as the outgoing envelope fold lines 30.

In an important aspect of the present invention, because all of the individual plies are generally equal in size, the mailers can accommodate billing insert plies which have heights as large as 12 to 18 inches and yet be classified as Postal Service "standard" size first class mail after they are folded into the outgoing envelope. This advantage allows the billing authority to print approximately twice the billing information found on a typical mailer having a height of 6½ inches.

Figure 6:
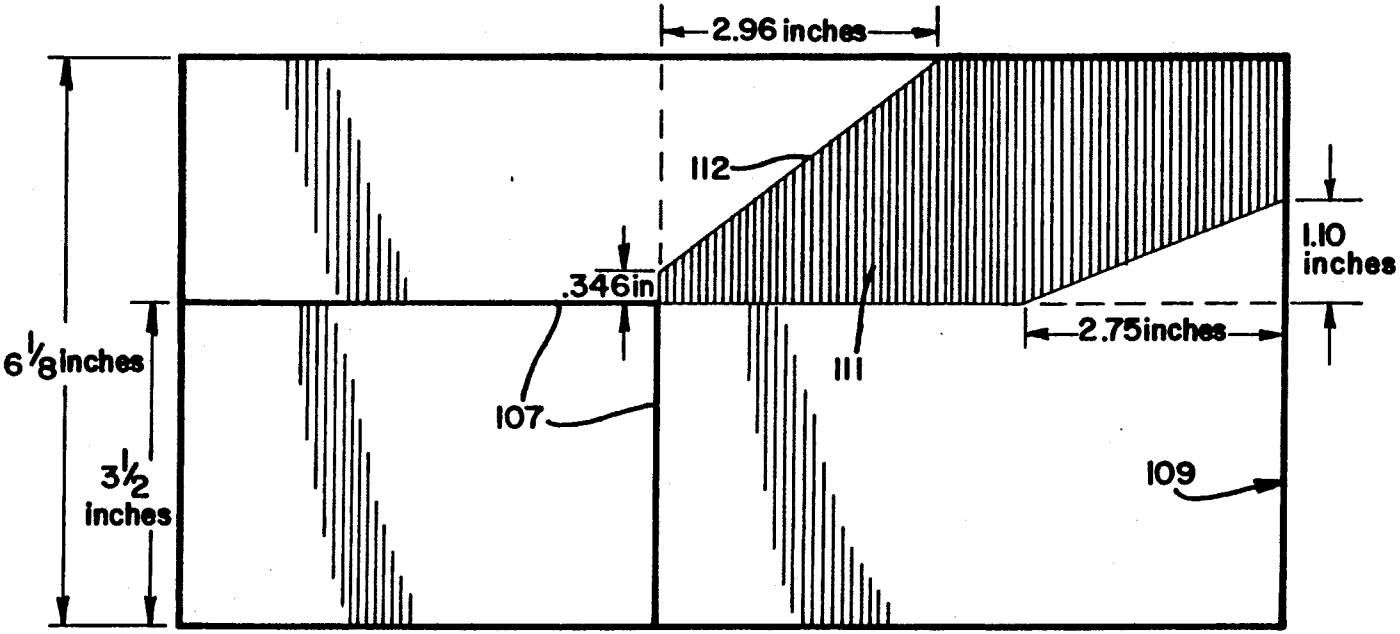
FIG. 6 shows a template illustrating the U.S. Postal Service dimensional guidelines for "standard" letter-size mail.
Figures 6A, 6B, 6C:
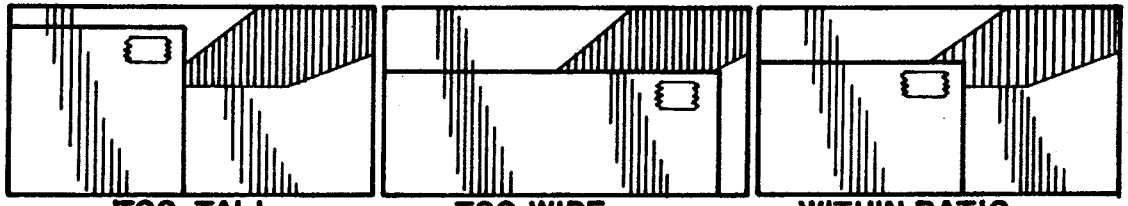
FIG. 6A shows a non-standard envelope which is too tall to be considered standard.
FIG. 6B shows a non-standard envelope which is too wide to be considered standard.
FIG. 6C shows a standard envelope which falls within the "standard" height to length ratio.

FIG. 6 illustrates the dimensional restrictions imposed upon letter-size first class mail by the 1978 U.S. Postal Service Regulations. FIG. 6 shows the minimum and maximum sizes for first-class letters and the height to length ratios of "standard" letter-size mail pieces. At its lower left, FIG. 6 includes a minimum size mail piece grid 107 which is 3½ inches high by 5 inches long. Any mail piece which does not completely fill the grid 107 or extend past both of the upper right grid lines of grid 107 is unmailable. The outer grid 109 of FIG. 6 defines the maximum dimensions for "standard" mail pieces which will avoid the first class postal surcharge. These dimensions are 6 inches high by 11½ inches long. Mail pieces which are larger than the minimum grid 107 and smaller than the maximum grid 109 must have a minimum height to length ratio of 1 to 1.3 and a maximum ratio of 1 to 2.5. The upper right corner of the mail piece must touch the shaded area 111 to be considered "standard" as shown in FIG. 6C. Mail piece sizes whose upper right corners fall outside the shaded area 111, as shown in FIGS. 6A–6B, are considered non-standard and are subject to an additional first class postal surcharge. In the shaded area 111, the left border 112 represents the minimum height to length ratio of 1 to 1.3 while the right border 113 represents the maximum height to length ratio of 1 to 2.5.

Both of the outgoing envelope and return envelope of mailers of the present invention, when folded along the appropriate envelope fold lines, fall within the above height to length ratios. As described above, the mailers can be either folded once along a first fold line 33 or twice along the first and second fold lines 31, 32 so that the final folded mailer outgoing envelope falls within the Postal Service "standard" classification. The billing authority is presented with a choice between the use of one or two outgoing envelope fold lines to accommodate larger billing insert sizes which fall within the Postal Service restrictions and avoid a postal surcharge.

Table 1 illustrates a variety of examples of final mailer sizes and height to length ratios which can be used to determine the billing insert (and remaining mailer) ply sizes. The minimum and maximum final mailer heights are listed according to ½ inch increments of dimensions fall within the FIG. 6 shaded area 111 and so are considered as "standard" under Postal Service guidelines.

TABLE 1

| FINAL MAILER DIMENSIONS | | | | |
|---|---|---|---|---|
| H min (in.) | H max (in.) | L (in.) | H min:L | H max:L |
| 3½ | 3¾ | 5½ | 1.57 | 1.46 |
| 3½ | 4½ | 6 | 1.71 | 1.3 |
| 3½ | 5 | 6½ | 1.85 | 1.3 |
| 3½ | 5⅜ | 7 | 2 | 1.3 |
| 3½ | 5¾ | 7½ | 2.14 | 1.3 |
| 3½ | 6⅛ | 8½ | 2.4 | 1.38 |
| 3⅜ | 6⅛ | 9 | 2.48 | 1.46 |
| 3¾ | 6⅛ | 9½ | 2.53 | 1.55 |
| 4 | 6⅛ | 10 | 2.5 | 1.63 |
| 4¼ | 6⅛ | 10½ | 2.47 | 1.71 |
| 4⅜ | 6⅛ | 11 | 2.5 | 1.79 |
| 4⅝ | 6⅛ | 11½ | 2.48 | 1.87 |

H min = minimum height of final folder mailer.
H max = maximum height of final folder mailer.
L = length of final folded mailer.
H min:L = height to length ratio for given length and minimum height
H max:L = height to length ratio for given length and maximum height.

By using the above table, one can readily determine if the billing insert size and resultant mailer will give a desired height to length ratio. This can be accomplished by dividing the height of the unfolded insert in half where a single fold line 30 will be used or the unfolded insert can be divided in thirds where two fold lines 31, 32 will be used. The resultant height and the insert length can be compared to Table 1 to determine if the height to length ratio is appropriate. Alternatively, one can choose a final mailer height and length dimension for Table 1 and either double or triple the final height to determine the unfolded insert and mailer dimensions. Thus, the mailer dimensions will be limited only by the outgoing envelope height to length ratio obtained by the outgoing envelope height to length ratio obtained and the size limitations of the mailer assembly and printing machinery.

For example, if the mailer plies 12 shown in FIGS. 1 and 2 are 12 inches high by 8½ inches long, the outgoing envelope fold lines 31, 32 will be spaced at equal 4 inch distances from the transverse edges 17, and the outgoing envelope, when folded, will have final dimensions of 4 inches high by 8½ inches long or a height to length ratio of 1 to approximately 2.1. Similarly, if the mailer plies shown in FIG. 4 are 8½ inches high by 8½ inches long and the single outgoing envelope fold line 33 divides the mailer into two equal portions, the outgoing envelopes will have final dimensions of 4¼ inches high by 8½ inches long and final height to length ratio of 1 to 2.

The present invention is particularly suited for automatic assembly and processing. Feeds of continuous webs 10 of the front, outgoing envelope ply 21 and the return back ply 24 may first be fed into a conventional ink printer for application thereto of the postal permit mark 103, outgoing envelope return address 38, the business reply return envelope mailing address 105 and the business reply mail indicator bar code 106. After exiting from the ink printer, those continuous webs next may be fed into an assembly along with continuous webs of a flysheet ply 20, if necessary, and the insert plies 22 and 23.

The assembler indexes and aligns all the plies together and assembles them into a mailer by depositing a conventional adhesive, such as heat activated adhesive, on either or both the top and bottom transverse edges 17 of individual mailers and may also further be deposited along the marginal edges 13 of the mailers, if necessary. Since no reduced size insert plies are used, it is possible to use virtually all of the insert plies available space for billing information, and therefore billing information may be printed as near the top and bottom of the insert plies as is possible.

At this point, the continuous feed of individual mailers may be inserted into an impact printer which prints the customer address and the customer bill onto the fly sheet of each mailer or the assembled mailers may be sent to the customer for printing. The address and billing information will be then transferred to the underlying plies by the image transfer means. The continuous feed of mailers are also scored along the transverse lines of weakening 19 and then burst or separated into individual mailers. Depending on the size format, the mailers are then folded once or twice upon themselves along the appropriate fold lines 30 and adhered together with adhesive strip 80 and mailed.

Although the embodiment discussed in the specification have described mailers of the present invention as having one or two insert plies, 22 and 23, it will be understood that the present invention encompasses mailers which use more than two inserts. Additionally, it will be understood that the embodiments discussed may be modified by those skilled in the art to conform to any changes in Postal Service first class mail size regulations without departing from the principles of the present invention.

Finally, it will understood that the embodiments of the present invention which have been described are merely illustrative of a few applications of the principles of the invention. Numerous modifications may be made by those skilled in the art without departing from the true spirit and scope of the invention.

I claim:

1. A self-contained insert mailer comprising at least two generally rectangular front and back plies adjacently overlying each other, the front and back ply each having substantially equal longitudinal and transverse dimensions each of said front and back plies being of substantially the same size and whereby substantially all of an inner message face of said back ply may be used to print message information thereon, said front and back plies being connected together at one common end thereof, the front ply of said two plies forming an outgoing envelope for said mailer when said mailer is folded upon itself along first and second transverse fold lines, said front ply having an outgoing envelope face portion and an outgoing envelope back portion separated by the first fold line, said first and second fold lines defining three mailer panels within each of said front and back plies wherein the first of the three mailer panels contains said outgoing envelope face portion, the second of said three mailer panels contains said outgoing envelope back portion, and said third of three mailer panels contains a mailer intermediate portion which is held in place between said outgoing envelope front and back portions, each of the three mailer panels being approximately one-third the size of said front and back plies, said back ply and said front ply being adhesively engaged together when said outgoing envelope is formed, a surface of said back ply having adhesive means which directly engages an opposing surface of said mailer intermediate portion without requiring the formation of separate openings or passages in said intermediate portion to permit formation of said outgoing envelope, said adhesive means being disposed along an edge thereof which is generally parallel to said mailer first and second fold lines, thereby permitting the opening of said outgoing envelope without the use of tear strips, said outgoing envelope having a predetermined height to length ratio conforming to postal height to length ratio standards, the predetermined height to length ratio of said mailer outgoing envelope falling between approximately 1:1.3 to approximately 1:2.5.

2. The mailer of claim 1, wherein said front and back plies are connected together along opposite, marginal edges thereof.

3. The mailer of claim 1, wherein said front and back plies include control strip means extending along longitudinal, opposite marginal edges of said front and back plies.

4. The mailer of claim 1, wherein said front ply includes image transfer means for transferring an image printed on said front ply to said back ply.

5. The mailer of claim 1, wherein said front ply includes a designated address area on a preselected location on said front ply outgoing envelope face portion, said designated address area preselected location conforming to postal specifications for optical character reading of mailer addresses.

6. The mailer of claim 1, wherein said front ply includes an opening therein in a designated location thereof, the opening permitting information printed on said back ply to be visible through said front ply.

7. The mailer of claim 1, wherein said back ply includes a detachable reply portion, the reply portion being defined by a line of weakening.

8. The mailer of claim 7, wherein said detachable reply portion is a postcard.

9. The mailer of claim 7, wherein said back ply reply portion has a built-up thickness which is greater than a thickness of said front ply.

10. The mailer of claim 1, wherein said back ply has a thickness which is greater than the thickness of said front ply, said back ply including a detachable reply portion defined by at least one line of weakening.

11. The mailer of claim 10, wherein said detachable reply portion is a postcard having a predetermined height to length ratio of between approximately 1:1.3 to approximately 1:2.5.

12. A connected series of self-contained mailers which are adapted to be printed by a computer and separated into distinct, individual self-contained mailers, each of said self-contained mailers including a front and back ply, comprising:

a continuous front outgoing envelope ply, a continuous back insert message ply, the back ply further including a detachable return portion, the back ply return portion being separated from a back ply insert portion by at least one line of weakening, each of said continuous front and back plies having longitudinally spaced, transverse lines of weakening defining distinct self-contained mailer assemblies, said continuous front and back plies of each self-contained mailer assembly having longitudinal and transverse edges which have substantially equal longitudinal and transverse dimensions, the respective longitudinal and transverse edges of said front and back plies being aligned together, each self-contained mailer assembly having first and second fold lines disposed between said transverse lines of weakening on each of said continuous front and back plies, said first and second fold lines defining three substantially equal sized mailer panels in each of said self-contained mailer assembly front and back plies, the first and second fold lines permitting each self-contained mailer assembly to be folded into three panels approximately equal to one-third the longitudinal dimension of self-contained mailer assembly, said self-contained mailer assembly including adhesive means directly engaging a portion of said continuous front ply to an opposing portion of said continuous back ply when said self-contained mailer assembly is formed along said first and second fold lines such that a first of said mailer assembly three panels is held between a second and a third panel of said mailer assembly three panels without requiring any modification of said second panel to permit said adhesive attachment between said second and third mailer assembly panels, said outgoing envelope having a predetermined height to length ratio conforming to postal height to length ration standards, said predetermined height to length ratio being between approximately 1:1.3 to approximately 1:2.5, said adhesive means being disposed on said continuous back ply opposing portion along a free edge thereof, said adhesive means further engaging said continuous front ply proximate to and parallel to said first fold line, thereby enabling said self-contained mailer assembly to be opened without the use of tear strips.

13. The series of mailers of claim 12, wherein said back ply return portion includes a postcard.

14. The series of mailers of claim 12, wherein said back ply portion includes a postcard having a height to length ratio of between approximately 1:1.3 and approximately 1:2.5.

15. The series of mailers of claim 12, wherein said back ply return portion has a thickness which is greater than a thickness of said first ply.

16. A self-contained insert mailer comprising at least two generally rectangular front and back plies adjacently overlying each other, the front and back ply each having substantially equal longitudinal and transverse dimensions each of said front and back plies being of substantially the same size and whereby substantially all of an inner message face of said back ply may be used to print message information thereon, said front and back plies being connected together at one common end thereof, the front ply of said two plies forming an outgoing envelope for said mailer when said mailer is folded upon itself along first and second transverse fold lines, said front ply having an outgoing envelope face portion and an outgoing envelope back portion separated by the first fold line, said first and second fold lines defining three mailer panels within each of said front and back plies wherein the first of the three mailer panels contains said outgoing envelope face portion, the second of said three mailer panels contains said outgoing envelope back portion, and said third of three mailer panels contains a mailer intermediate portion which is held in place between said outgoing envelope front and back portions, each of the three mailer panels being approximately one-third the size of said front and back plies, said back ply and said front ply being adhesively engaged together when said outgoing envelope is formed, a surface of said back ply having adhesive means which directly engages an opposing surface of said mailer intermediate portion without requiring the formation of separate openings or passages in said intermediate portion to permit formation of said outgoing envelope, said adhesive means being disposed along an edge thereof which is generally parallel to said mailer first and second fold lines, thereby permitting the opening of said outgoing envelope without the use of tear strips, said back ply including a detachable reply portion in the form of a postcard, the detachable reply portion being defined by a line of weakening, said outgoing envelope having a predetermined height to length ratio conforming to postal height to length ratio standards, the predetermined height to length ratio of said mailer outgoing envelope falling between approximately 1:1.3 to approximately 1:2.5.

17. The mailer of claim 16, wherein said back ply detachable reply portion has a built-up thickness which is greater than a thickness of said front ply.

18. The mailer of claim 16, wherein said detachable reply portion postcard has a predetermined height to length ratio of between approximately 1:1.3 to approximately 1:2.5.

19. The mailer of claim 16, wherein said front ply includes image transfer means for transferring an image printed on said front ply to said back ply.

20. A self-contained insert mailer comprising at least two generally rectangular front and back plies adjacently overlying each other, the front and back ply each having substantially equal longitudinal and transverse dimensions each of said front and back plies being of substantially the same size and whereby substantially all of an inner message face of said back ply may be used to print message information thereon, said front and back plies being connected together at one common end thereof, the front ply of said two plies forming an outgoing envelope for said mailer when said mailer is folded upon itself along first and second transverse fold lines, said front ply having an outgoing envelope face portion and an outgoing envelope back portion separated by the first fold line, said first and second fold lines defining three mailer panels within each of said front and back plies wherein the first of the three mailer panels contains said outgoing envelope face portion, the second of said three mailer panels contains said outgoing envelope back portion, and said third of three mailer panels contains a mailer intermediate portion which is held in place between said outgoing envelope front and back portions, each of the three mailer panels being approximately one-third the size of said front and back plies, said back ply including a detachable reply portion, the reply portion being detachably defined in said back portion by a line of weakening, said back ply and said front ply being adhesively engaged together when said outgoing envelope is formed, a surface of said back ply having adhesive means which directly engages an opposing surface of said mailer intermediate portion without requiring the formation of separate openings or passages in said intermediate portion to permit formation of said outgoing envelope, said adhesive means being disposed along an edge thereof which is generally parallel to said mailer first and second fold lines, thereby permitting the opening of said outgoing envelope without the use of tear strips, said outgoing envelope having a predetermined height to length ratio conforming to postal height to length ration standards, the predetermined height to length ratio of said mailer outgoing envelope falling between approximately 1:1.3 to approximately 1:2.5.

* * * * *